US005946749A

United States Patent [19]

Sewell

[11] Patent Number: 5,946,749

[45] Date of Patent: Sep. 7, 1999

[54] COMFORT LOUNGE CHAIR

[76] Inventor: Cheryl H. Sewell, 20 Dogwood Trail, Jasper, Ga. 30143

[21] Appl. No.: 09/177,544

[22] Filed: Oct. 22, 1998

[51] Int. Cl.[6] ..... A47C 17/66; A47C 17/64

[52] U.S. Cl. ..... 5/110; 5/725; 5/507.1; 297/900; 297/188.08

[58] Field of Search ..... 5/110, 111, 725, 5/638, 656, 507.1, 503.1; D6/361; 297/900, 188.08, 188.01

[56] References Cited

U.S. PATENT DOCUMENTS

| | | | |
|---|---|---|---|
| D. 352,635 | 11/1994 | Yoder | D6/361 |
| 2,810,920 | 10/1957 | Carruth | 5/725 |
| 3,302,218 | 2/1967 | Stryker | 5/507.1 |
| 3,351,312 | 11/1967 | Ballas | 5/507.1 |
| 3,609,779 | 10/1971 | Oja et al. | 5/638 |
| 3,897,102 | 7/1975 | Lemaire | 297/191 |
| 4,606,086 | 8/1986 | Rowland | 5/111 |
| 4,941,222 | 7/1990 | Prager | 5/111 |
| 5,121,969 | 6/1992 | Schroeder | 297/397 |
| 5,222,779 | 6/1993 | Johnson | 297/191 |
| 5,466,039 | 11/1995 | Umbrianna | 297/900 |
| 5,624,157 | 4/1997 | Kostuk | 297/228.13 |
| 5,829,080 | 11/1998 | Robillard et al. | 5/638 |

*Primary Examiner*—Alexander Grosz
*Attorney, Agent, or Firm*—Joseph N. Breaux

[57] ABSTRACT

A comfort lounge chair comprising a seat member for supporting a lower torso and legs of a person in a prone position. A structure elevates the seat member up off of an underlaying surface. A back portion is pivotally connected to the seat member for supporting an upper torso, arms and head of the person in the prone position. The back portion has an opening therethrough, so that the opening can comfortably receive a face of the person lying on their stomach in the prone position, without obstruction of eyes nose and mouth.

3 Claims, 2 Drawing Sheets

COMFORT LOUNGE CHAIR

TECHNICAL FIELD

The present invention relates to chaise lounges and more particularly to a comfort lounge chair. The comfort lounge chair includes a back portion, having a padded opening for receiving a person's face, so that the person can lie on their stomach while eyes, nose and mouth are visible through the padded opening. An adjustable height book holder is located on the underside of the back portion and includes height adjustment arms as well as a shelf for maintaining the pages of the book in an open configuration. Each side edge of the back portion of the comfort lounge chair includes a cutout area for the arms of the person, so as to allow for easy access to the book and other items on the shelf of the book holder. Additionally, a drink holder can be formed into the shelf for allowing the person to drink a beverage with a straw.

BACKGROUND ART

Numerous chaise lounges have been provided in prior art. For example, U.S. Pat. Nos. 3,897,102 to Lemaire; 4,606,086 to Rowland; 4,941,222 to Prager; 5,121,969 to Schroeder; 5,222,779 to Johnson; and 5,624,157 to Kostuk all are illustrative of such prior art. While these units may be suitable for the particular purpose to which they address, they would not be as suitable for the purposes of the present invention as heretofore described.

The Lemaire U.S. Pat. No. 3,897,102 discloses a chair or the like. The disclosure relates to a chair, more particularly, to a lounge chair which is made of a frame and a flexible material, such as canvas, associated with the frame for supporting the body of a person. The chair has a back portion which is formed with a first aperture shaped to enable a person who lies flat on his stomach to rest his head while being able to see through the first aperture. The back portion also comprises second and third apertures which are adapted to permit passing the arms of the person therethrough.

The Rowland U.S. Pat. No. 4,606,086 discloses a lounge chair for reading. An improved lounge chair to support a person adjustable from a sitting to a prone position. The portion of the chair supporting the person's upper body has an opening provided therein large enough so that when a person's face is placed against the opening, the eyes, nose and mouth are unobstructed by any portion of the chair.

The Prager U.S. Pat. No. 4,941,222 discloses a portable lounge. This invention relates to a portable lounge with body supports which are adjustable to conform with body frames of different girths and heights. It is ergonomically correct to alleviate stress on the lower back, head, neck and legs by reducing pressure while relaxing.

The Schroeder U.S. Pat. No. 5,121,969 discloses an adjustable head rest for lounges. An adjustable head rest for chaise lounges that allows a person to lie on their stomach without the necessity of turning their head. The head rest is constructed of a frame that fits between the slats of an existing chaise lounge and is adjustable by moving the portion beneath the slats in toward or away from the lounge. The extended end of the frame has a head support in the form of a strap attached across the frame. The head support is mounted on an angle portion of the frame that provides a comfortable position to rest the forehead. In a preferred embodiment of the invention the frame is in a U-shaped construction with the head support being slidable from an open end of the U-shaped frame to the closed end to allow the adjustable head rest to be reversible for use with most types of chaise lounges. The U-shaped frame preferably has hinges and telescoping arms to allow the head rest to collapse to a small package for ease of transporting.

The Johnson U.S. Pat. No. 5,222,779 discloses a chaise lounge. At times a person may wish to lie on a chaise lounge in a prone position. The chaise lounge has a head support section that includes a head rest. The head rest has a T-shaped or triangular opening for accommodating the person's face. The head support section also has an area of reduced width to accommodate the person's arms. The person can thus hold and read a book or magazine located below the chaise lounge.

The Kostuk U.S. Pat. No. 5,624,157 discloses a cover for a folding lounge. A fabric cover for a lounge chair to be fitted onto an adjustable folding metal frame, the frame being constructed principally of tubular metal including U-shaped foot and head portions. The cover includes a pocket fitted over the U-shaped foot portion of the frame and a second pocket fitted over the U-shaped head portion of the frame. The second pocket includes a padded inner lining and contains a hole fitted to the face of a person lying on the lounge chair on his or her stomach. The cover also includes two similar rectangular side panels attached to the opposite sides of the center portion of the cover, each having along its edge opposite to the edge attached to the center portion of the cover attachments for joining two side panel edges together, in order to secure the cover onto the metal frame.

GENERAL SUMMARY DISCUSSION OF INVENTION

The comfort lounge chair consists of a frame fabricated of aluminum with an attached seat member made of a durable plastic or fabric covered foam pad. The center area of a back portion features a padded oval shaped face opening. An internal sliding cover allows the face opening to be closed off when not in use. The underside of the frame has legs and incorporates an adjustable fold up book holder. A cutout area on each side edge of the back portion allows the person to easily reach under to hold a book while lying on their stomach and read through the face opening. The design of the frame allows the back portion to be adjusted up and down, while the entire lounge chair will fold up compactly for transport or storage.

A primary object of the present invention is to provide a comfort lounge chair that will overcome the shortcomings of the prior art devices.

Another object is to provide a comfort lounge chair that is a chaise type lawn or lounge chair with a padded opening in a back portion for a person's face, so that a sliding cover will allow the face opening to be opened or closed as desired.

An additional object is to provide a comfort lounge chair in which the underside of the back portion features an adjustable book holer, with the side edges of the back portion having cutout areas allowing the person to easily reach the book being read.

A further object is to provide a comfort lounge chair that is simple and easy to use.

A still further object is to provide a comfort lounge chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous refer numbers and wherein.

Similar reference characters denote corresponding features consistently throughout the attached drawings.

EXEMPLARY MODE FOR CARRYING OUT THE INVENTION

Figure 1:
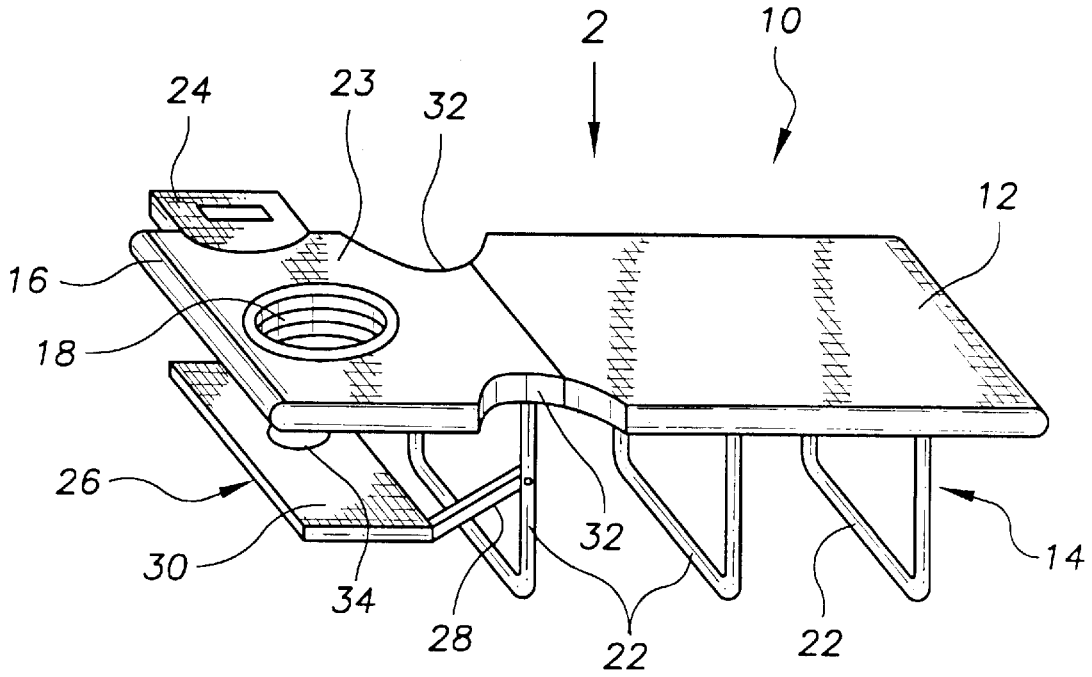
FIG. 1 is a perspective view of the present invention.
Figure 2:
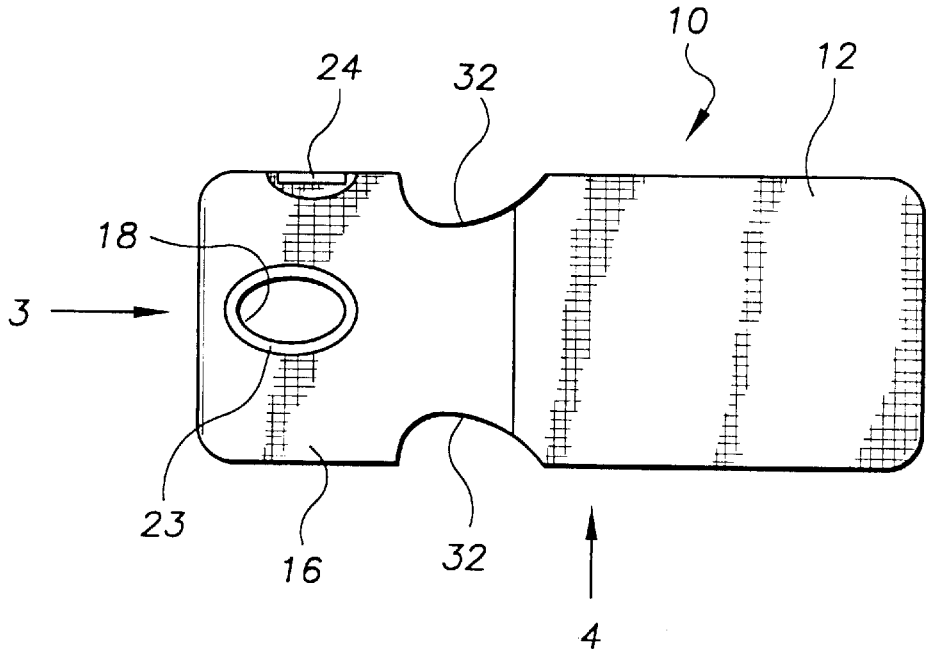
FIG. 2 is a top view taken in the direction of arrow 2 in FIG. 1.
Figure 3:
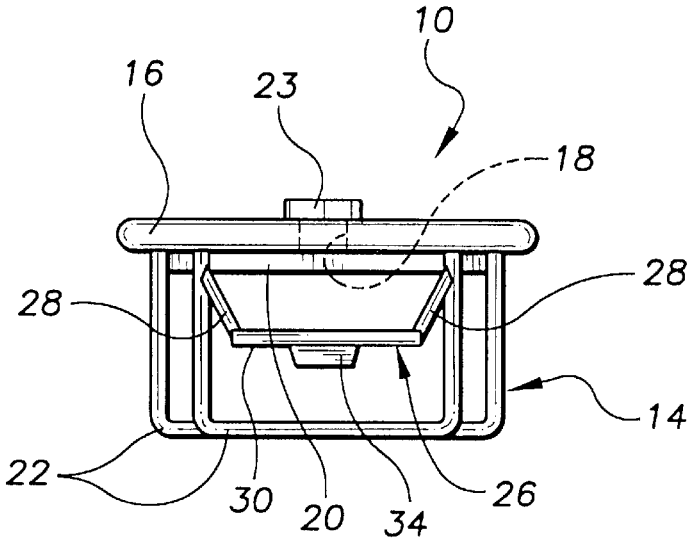
FIG. 3 is a front view taken in the direction of arrow 3 in FIG. 2.
Figure 4:
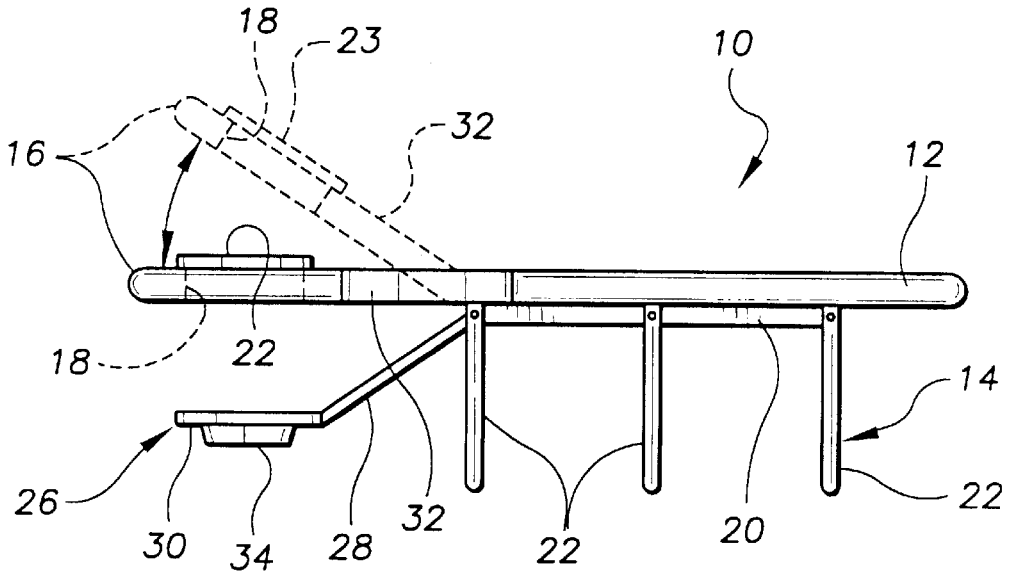
FIG. 4 is a side view taken in the direction of arrow 4 in FIG. 2.

Turning now descriptively to the drawings, in which similar reference characters denote similar elements throughout the several views, FIGS. 1 through 4 illustrate the various features of the present invention being a comfort lounge chair 10 comprising a seat member 12 for supporting a lower torso and legs of a person in a prone position. A structure 14 elevates the seat member 12 up off of an underlying surface, such as a patio or the ground. A back portion 16 is pivotally connected to seat member 12 for supporting an upper torso, arms and head of the person in the prone position. Back portion 16 has an opening 18 therethrough, so that opening 18 can comfortably receive a face of the person lying on their stomach in the prone position, without obstruction of eyes, nose and mouth.

The elevating structure 14 is a frame 20 having a plurality of legs 22 pivotally connected thereto and extends downwardly from frame 20. Back portion 16 includes a padded rim 23 about face opening 18 to enhance comfort to the face of the person. Back portion 16 contains an internal sliding cover 24 at one side edge, which when manually operated will allow face opening 18 to be closed off when not in use and face opening 18 to be opened when in use.

An adjustable book holder 26 is provided to enable the person while in the prone position on their stomach to read a book on book holder 26 through face opening 18 in back portion 16 without having to hold the book by the hands. Book holder 26 consists of a pair of spaced apart arms 28. Each arm 28 is pivotally attached at a first end to one side of leg 22 nearest to back portion 16. A shelf 30 is pivotally attached at each side to a second end of each arm 28. Shelf 30 can be manually positioned under face opening 18 in back portion 16 to maintain pages of the book in an open configuration, thereby allowing the person to read the book.

Back portion 16 has a cutout area 32 at each side edge for each arm of the person, so as to allow for easy access to books and other items on shelf 30 of book holder 26. The shelf 30 of book holder 26 can also include a drink holder 34 formed therein, to allow the person to drink a beverage with a straw.

It can be seen from the preceding description that in use, a person who desires to sunbathe more comfortably while lying on their stomach will simply open the comfort lounge chair 10 and the internal sliding cover 24. The person is then free to enjoy the benefit of being able to lie on their stomach with the face comfortably positioned in the padded face opening 18. If the person wants to read while sunbathing on their stomach, they will adjust the book holder 26 as desired, place the book on the shelf 30 and then enjoy being able to read through the face opening 18. The cutout area 32 on each side edge of the back portion 16 allows the person to reach under the back portion 16 and hold the book while reading. With the internal sliding cover 24 closed, the comfort lounge chair 10 will perform as a standard reclining lawn or lounge chair. Use of the comfort lounge chair 10 will provide a very convenient and easy to use way of allowing a person to sunbath and/or read while lying face down, with far greater comfort.

It is noted that the embodiment of the comfort lounge chair described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A comfort lounge chair comprising:

a seat member for supporting a lower torso and legs of a person in a prone position;

means for elevating said seat member up off of an underlying surface, said elevating means being a frame having a plurality of leas pivotally connected thereto and extending downwardly from said frame:

a back portion pivotally connected to said seat member for supporting an upper torso, arms and head of the person in the prone position, said back portion having an opening therethrough, so that said opening can comfortably receive a face of the person lying on their stomach in the prone position, without obstruction of eyes, nose and mouth; and an adjustable book holder enabling the person while in the prone position on their stomach to read a book on said book holder through said face opening in said back portion without having to hold the book by the hands, said book holder consisting of a pair of spaced apart arms in which each said arm is pivotally attached at a first end to one side of said leg nearest to said back portion; and a shelf pivotally attached at each side to a second end of each said arm, so that said shelf can be manually positioned under said face opening in said back portion to maintain pages of the book in an open configuration thereby allowing the person to read the book.

2. The comfort lounge chair as recited in claim 1, wherein:

said back portion has a cutout area at each side edge for each arm of the person, so as to allow for easy access to books and other items on said shelf of said book holder.

3. The comfort lounge chair as recited in claim 2, wherein:

said shelf of said book holder includes a drink holder formed therein to allow the person to drink a beverage with a straw.

* * * * *